US007704656B2

(12) United States Patent
Fu et al.

(10) Patent No.: US 7,704,656 B2
(45) Date of Patent: Apr. 27, 2010

(54) PHOTOCONDUCTIVE IMAGING MEMBER

(75) Inventors: Min-Hong Fu, Webster, NY (US); Kent J. Evans, Lima, NY (US); David M. Skinner, Rochester, NY (US); Kathleen M. Carmichael, Williamson, NY (US); June E. Schneider, Honeoye Falls, NY (US); Susan M. VanDusen, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 206 days.

(21) Appl. No.: 11/087,333

(22) Filed: Mar. 23, 2005

(65) Prior Publication Data

US 2006/0216620 A1 Sep. 28, 2006

(51) Int. Cl.
*G03G 5/07* (2006.01)

(52) U.S. Cl. ..... 430/59.6; 430/56.05; 430/62; 430/64

(58) Field of Classification Search ..... 430/56.05, 430/59.6, 64, 62
See application file for complete search history.

(56) References Cited

U.S. PATENT DOCUMENTS

| | | | | |
|---|---|---|---|---|
| 3,121,006 | A | | 2/1964 | Middleton et al. |
| 4,081,274 | A | | 3/1978 | Horgan |
| 4,115,116 | A | | 9/1978 | Stolka et al. |
| 4,233,384 | A | | 11/1980 | Turner et al. |
| 4,265,990 | A | | 5/1981 | Stolka et al. |
| 4,298,697 | A | | 11/1981 | Baczek et al. |
| 4,299,897 | A | | 11/1981 | Stolka et al. |
| 4,304,829 | A | | 12/1981 | Limburg et al. |
| 4,306,008 | A | | 12/1981 | Pai et al. |
| 4,338,390 | A | | 7/1982 | Lu |
| 4,391,889 | A | * | 7/1983 | Mabuchi et al. ..... 430/58.45 |
| 4,439,507 | A | | 3/1984 | Pan et al. |
| 4,464,450 | A | | 8/1984 | Teuscher |
| 4,560,635 | A | | 12/1985 | Hoffend et al. |
| 4,725,518 | A | | 2/1988 | Carmichael et al. |
| 4,840,861 | A | * | 6/1989 | Staudenmayer et al. .. 430/58.75 |
| 4,874,682 | A | | 10/1989 | Scott et al. |
| 5,164,276 | A | * | 11/1992 | Robinson et al. ..... 430/58.35 |
| 5,356,741 | A | | 10/1994 | Carmichael et al. |
| 5,492,785 | A | | 2/1996 | Normandin et al. |
| 6,214,514 | B1 | | 4/2001 | Evans et al. |
| 6,326,111 | B1 | | 12/2001 | Chambers et al. |
| 6,337,166 | B1 | | 1/2002 | Chambers et al. |
| 6,410,196 | B1 | * | 6/2002 | Carmichael et al. ..... 430/59.6 |
| 6,699,850 | B2 | | 3/2004 | Reszka et al. |
| 2001/0049067 | A1 | * | 12/2001 | Mitsumori et al. ..... 430/58.8 |
| 2002/0037463 | A1 | * | 3/2002 | Itami et al. ..... 430/66 |
| 2003/0087173 | A1 | * | 5/2003 | Kumano et al. ..... 430/96 |
| 2005/0079431 | A1 | * | 4/2005 | Kobashi et al. ..... 430/59.6 |

* cited by examiner

*Primary Examiner*—Mark F Huff
*Assistant Examiner*—Peter L Vajda
(74) *Attorney, Agent, or Firm*—Fay Sharpe LLP

(57) ABSTRACT

A photoreceptor comprising a charge transport layer doped with a polyarylate polymer is provided. A charge transport layer is doped with about 0.1 to about 10.0% by weight, solids basis, of a polyarylate polymer, such as for example Ardel. Charge transport layers doped with a polyarylate polymer exhibit improved electrical performance in terms of lower $V_r$ and $V_{BG}$ values.

13 Claims, 1 Drawing Sheet

PHOTOCONDUCTIVE IMAGING MEMBER

CROSS REFERENCE

There is illustrated in U.S. Ser. No. 10/762,669, filed Jan. 22, 2004, the disclosure of which is incorporated herein by reference in its entirety, a photoconductive imaging member comprising a photogenerating layer and a charge transport layer, wherein the charge transport layer contains a polymeric solid acid.

There is illustrated in U.S. Ser. No. 10/944,914, filed Sep. 21, 2004, the disclosure of which is incorporated herein by reference in its entirety, a charge transport layer composition for a photoreceptor and an image forming device comprising a photoreceptor and charging device wherein the photoreceptor comprises, among other components, such a charge transport layer composition. The charge transport layer composition comprises at least a binder, at least one aryl amine charge transport material, and at least one polymer containing carboxylic acid groups or groups capable of forming carboxylic acid groups, such as, for example, a copolymer of 4,4-bis[4-hydroxyphenyl]valeric acid/bisphenol A polycarbonate.

BACKGROUND

The present disclosure relates, in various embodiments thereof, to charge transport layer compositions and photoconductive imaging members comprising such compositions. In particular, the present disclosure relates to charge transport layers comprising a binder, a charge transport material, and a doping agent. The doping agent is a polyarylate material.

In the art of electrophotography, an electrophotographic imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper. This imaging process may be repeated many times with reusable photosensitive members.

Electrophotographic imaging members are usually multilayered photoreceptors that comprise a substrate support, an electrically conductive layer, an optional hole blocking layer, an optional adhesive layer, a charge generating layer, a charge transport layer, and optional protective or overcoating layer(s). The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness.

One type of multi-layered photoreceptor that has been employed as a belt in electrophotographic imaging systems comprises a substrate, a conductive layer, a charge blocking layer, a charge generating layer, and a charge transport layer. The charge transport layer often comprises an activating charge transport molecule dispersed or dissolved in a polymeric film forming binder. Generally, the polymeric film forming binder in the transport layer is electrically inactive by itself and becomes electrically active when it contains the activating molecule. The expression "electrically active" means that the material is capable of supporting the injection of photogenerated charge carriers from the material in the charge generating layer and is capable of allowing the transport of these charge carriers through the electrically active layer in order to discharge a surface charge on the active layer. The multi-layered type of photoreceptor may also comprise additional layers such as an anti-curl backing layer, required when layers possess different coefficient of thermal expansion values, an adhesive layer, and an overcoating layer. Commercial high quality photoreceptors have been produced which utilize an anti-curl coating.

U.S. Pat. No. 4,265,990 discloses a layered photoreceptor having a separate charge generating (photogenerating) layer (CGL) and charge transport layer (CTL). The charge generating layer is capable of photogenerating holes and injecting the photogenerated holes into the charge transport layer. The photogenerating layer utilized in multilayered photoreceptors includes, for example, inorganic photoconductive particles or organic photoconductive particles dispersed in a film forming polymeric binder. Inorganic or organic photoconductive materials may be formed as a continuous, homogeneous photogenerating layer.

Examples of photosensitive members having at least two electrically operative layers including a charge generating layer and diamine containing transport layer are disclosed in U.S. Pat. Nos. 4,265,990, 4,233,384, 4,306,008, 4,299,897 and 4,439,507. The disclosures of these patents are incorporated herein in their entirety.

As more advanced, complex, highly sophisticated, electrophotographic copiers, duplicators and printers are developed, greater demands are placed on the photoreceptor to meet stringent requirements for the production of high quality images. Along these lines, many photoreceptor systems have stringent requirements on the electrical properties of the photoreceptor, such as, for example, the background potential ($V_{BG}$) and residual potential ($V_r$).

Variations in the electrical properties of a photoconductive element result in unacceptable variance in residual potential ($V_r$), and background potential ($V_{BG}$). $V_{BG}$ is defined as the potential in the background or light struck areas of a photoconductive element after exposure to a pattern of activating electromagnetic radiation such as light. Unpredictable variations in $V_{BG}$ can adversely affect copy quality, especially in complex, high volume, high speed copiers, duplicators and printers which by their very nature require photoconductive element properties to meet precise narrow operating windows. Consequently, photoconductive elements that have poor $V_{BG}$ characteristics are also unacceptable or require expensive and sophisticated control systems or trained repair persons to alter machine operating parameters. Inadequate compensation of $V_{BG}$ variations can cause copies to appear too light or too dark. In addition, such variations in $V_{BG}$ properties preclude optimization of $V_{BG}$ properties.

$V_r$ is defined as the remaining surface potential after full discharge from white light exposures in excess of 200 ergs-cm$^2$. $V_r$ and $V_{BG}$ impact photoreceptor development efficiency and thereby impact image quality. Relatively low $V_r$ and $V_{BG}$ are desired for optimal photoreceptor performance.

Control of $V_r$, and $V_{BG}$ of photoconductive elements is important not only initially but through the entire cycling life of the photoconductive element. During the electrophotographic process, the photoconductive element is subjected to a series of charge and illumination steps which often produce changes in the electric and optical properties of the photoconductive element. These changes are called fatigue. Fatigue causes the operating characteristics to vary during the life of the photoconductive elements and is undesirable in actual commercial usage.

A common factor which produces variable $V_r$ and $V_{BG}$ in photoconductive elements is the small, uncontrollable variation in acidic or basic chemical impurities in the system. Additives to the photoconductive element's layer or layers may reduce or eliminate the effects of impurities. For example, U.S. Pat. No. 4,874,682 describes a monomeric or polymeric nonvolatile basic amine incorporated in a charge transport layer to eliminate the fatigue effect of acids. In another example, U.S. Pat. No. 4,725,518, the entire disclosure of which is incorporated by reference herein, discloses addition of an aromatic amine compound and a protonic acid or Lewis acid in a charge transport layer to control $V_r$, dark development potential ($V_{DDP}$) and $V_{BG}$.

Another known treatment of photoconductive elements to control acidic or basic variations affecting $V_r$, $V_{DDP}$ and $V_{BG}$ involves doping the photoconductive element with other acids and bases. For example, a variance in $V_r$, $V_{DDP}$ and $V_{BG}$ may be controlled by the addition of trifluoroacetic acid to the transport layer in amounts ranging from about 0.1 to 100 ppm. However, the actual amount varies and must be determined by frequent measurement during the manufacturing process of the electrical behavior of the device. The dopant content is readjusted to compensate for the quantity of acid necessary to achieve the desired electrical specifications. This acid doping procedure is tedious, time-consuming and difficult to predictably control. Additionally, while the use of acids to dope the charge transport layer is known to lower $V_r$ and/or $V_{BG}$, these lower potentials are reduced at the expense of dark decay.

U.S. Pat. No. 6,337,166 discloses a wear resistant charge transport layer comprising at least a polycarbonate polymer binder having a number average molecular weight of not less than 35,000, at least one charge transport material, polytetrafluoroethylene particle aggregates having an average size of less than about 1.5 microns and a fluorine-containing polymeric surfactant dispersed in a solvent mixture of at least tetrahydrofuran and toluene. The dispersion forms a uniform stable material. U.S. Pat. No. 6,326,111 discloses adding hydrophobic silica to such a composition.

U.S. Pat. No. 5,164,276 describes photoreceptors that incorporate a dopant in one or both of the charge generation layer or the charge transport layer. The dopant includes organic molecules containing basic electron donor or proton acceptor groups. Preferred dopants include aliphatic and aromatic amines, triethanolamine, n-dodecylamine, n-hexadecylamine, tetramethyl guanidine, 3-aminopropyltriethoxy silane, 3-aminopropyltrihydroxysilane and its oligomers.

U.S. Pat. No. 5,356,741 describes a process for controlling variations in electrical characteristics of a electrophotographic imaging device by eliminating the effect of acidic and basic impurities in a photoconductive element. The process includes coating a substrate with a first dispersion to form a charge generating layer, and then coating with a second dispersion to form a charge transport layer, wherein at least one of the first or second dispersions includes a solution of weak acid or weak base and the conjugate salt of weak acid or weak base in an amount effective to reduce variations in dark development potential and background potential characteristics of an imaging device.

It is still desirable to provide a charge transport layer composition that offers improved photoreceptor performance. Along these lines, it is desirable to provide a charge transport layer composition that allows for increased photoreceptor sensitivity via improved electrical properties. It is desirable to provide a charge transport layer composition for a photoreceptor that reduces at least one of the $V_r$ and $V_{BG}$. It is also desirable to provide a charge transport layer composition for a photoreceptor that reduces at least one of the $V_r$ and $V_{BG}$ and lowers the dark decay of the photoreceptor.

BRIEF DESCRIPTION

The present disclosure relates, in embodiments thereof, to a photoconductive imaging member comprising a substrate, an optional hole blocking layer, a charge generating layer, and a charge transport layer, wherein said charge transport layer comprises a binder, a charge transport material, and a polyarylate polymer.

Additionally, the present disclosure, in other embodiments thereof, is directed to a photoconductive imaging member comprising a substrate, an optional hole blocking layer, a charge generating layer, a charge transport layer comprising a binder, a charge transport material, and a polyarylate doping agent in an amount of from about 0.1 to about 10 percent by weight, solids basis, of the charge transport layer.

In a further embodiment, the doping agent comprises a phthalate moiety and a diphenol moiety having the formula

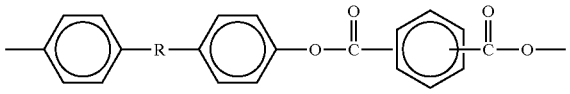

wherein R is selected from the group consisting of $C_1$-$C_6$ alkylene.

The present disclosure also relates, in further embodiments thereof, to a photoconductive imaging member comprising a substrate, an optional hole blocking layer, a charge generating layer, and a charge transport layer comprising a charge transport material, a binder, and a doping agent in an amount of from about 0.1 to about 10.0 percent, solids basis, of the charge transport layer, wherein said doping agent is a polyarylate polymer. The polyarylates include those prepared from isophthalic or terephthalic acids and bisphenol A.

These and other non-limiting characteristics of the development are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

The present disclosure relates to a photoreceptor that includes a charge transport layer (CTL) with a CTL composition comprising a doping agent. More specifically, the disclosure relates to CTLs doped with a polyarylate polymer.

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697; and, 4,338,390, the disclosures of which are totally incorporated herein by reference, subsequently transferring the image to a suitable substrate, and permanently affixing the image thereto.

Figure 1:
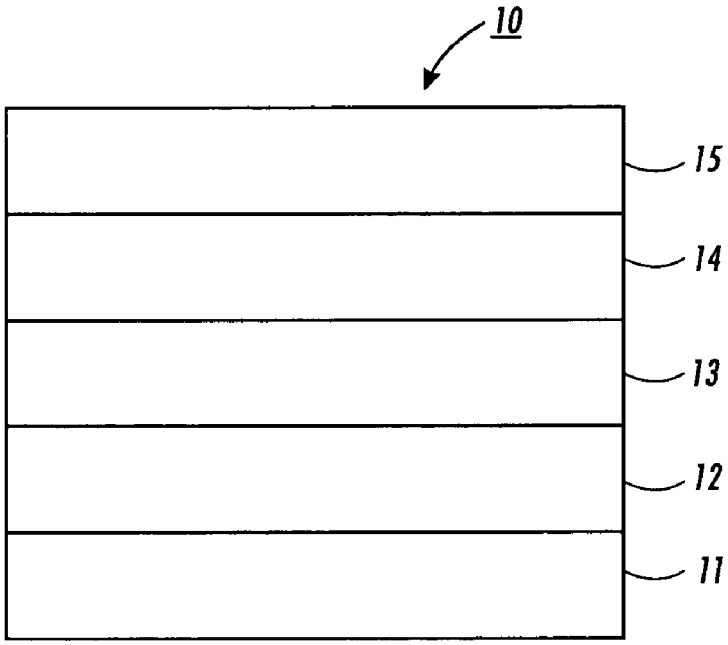
FIG. 1 is a schematic representation of a photoreceptor comprising a CTL in accordance with the present disclosure; and, FIG. 2 is a schematic representation of a photoreceptor comprising a CTL in accordance with the present disclosure.
Figure 2:
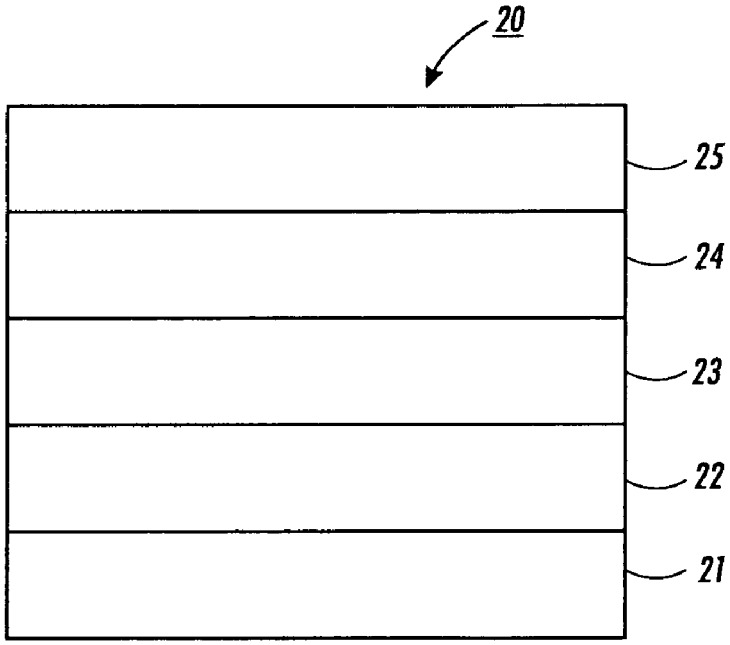

Generally, electrophotographic imaging members comprise a supporting substrate having an electrically conductive surface or coated with an electrically conductive layer, an optional charge blocking layer, an undercoat layer, a charge generating layer, a charge transport layer and an optional overcoating layer. FIGS. 1 and 2 display suitable configurations of a photoreceptor in accordance with the present disclosure. The configurations in FIGS. 1 and 2 are merely illustrative embodiments and not intended to be limiting in any manner. It will be appreciated by persons skilled in the art that other configurations may be possible.

With reference to FIG. 1, a photoreceptor 10 comprises a substrate 11, an optional hole blocking layer 12, a charge generating layer 13, a charge transport layer 14, and an optional overcoat layer 15. The charge transport layer 14 includes a charge transport layer composition doped with a polyarylate polymer.

With reference to FIG. 2, a photoreceptor 20 comprises a substrate 21, an optional hole blocking layer 22, a charge transport layer 23, a charge generating layer 24, and an optional overcoat layer 25. The charge transport layer 23 includes a charge transport layer composition doped with a polyarylate polymer.

The substrate may be opaque or substantially transparent and may comprise numerous suitable materials having the required mechanical properties. Accordingly, the substrate may comprise a layer of an electrically non-conductive or conductive material such as an inorganic or an organic composition. The electrically conductive layer may comprise the entire supporting substrate or merely be present as a coating on an underlying rigid or flexible web member. Any suitable electrically conductive material may be utilized. Typical electrically conductive materials include, for example, aluminum, titanium, zirconium, nickel, chromium, brass, gold, stainless steel, copper iodide, and the like. When the conductive layer is to be flexible, it may vary in thickness over substantially wide ranges depending on the desired use of the electrophotoconductive member. Accordingly, the conductive layer can generally range in thicknesses of from about 50 Angstrom to about 150 micrometers. As electrically non-conducting materials there may be employed various thermoplastic and thermoset resins known for this purpose including polyesters, polycarbonates, polyamides, polyurethanes, and the like. The substrate may have any suitable shape such as, for example, a flexible web, rigid cylinder, sheet and the like.

The thickness of a flexible substrate support depends on numerous factors, including economical considerations, and thus this layer for a flexible belt may be of substantial thickness, for example, over 200 micrometers, or of minimum thickness less than 50 micrometers, provided there are no adverse affects on the final photoconductive device.

Optionally, a photoreceptor includes a hole blocking layer. Any suitable hole blocking layer capable of forming an electronic barrier to holes between the adjacent photoconductive layer and the underlying conductive layer may be utilized. A hole blocking layer may comprise any suitable material. Typical hole blocking layers utilized for the negatively charged photoreceptors may include, for example, Luckamide, hydroxy alkyl methacrylates, nylons, gelatin, hydroxyl alkyl cellulose, organopolyphosphazines, organosilanes, organotitanates, organozirconates, silicon oxides, zirconium oxides, and the like. In embodiments, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxysilane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An example of a particularly suitable blocking layer comprises a reaction product between a hydrolyzed silane and the oxidized surface of an underlying conductive layer which inherently forms on the surface of a conductive metal layer when exposed to air after deposition. This combination reduces spots at time 0 and provides electrical stability at low relative humidity. The imaging member is prepared by depositing on the conductive layer of a coating of an aqueous solution of the hydrolyzed silane at a pH between about 4 and about 10, drying the reaction product layer to form a siloxane film and applying electrically active layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450, the disclosure of which is incorporated by reference herein in its entirety. After drying, the siloxane reaction product film formed from the hydrolyzed silane contains larger molecules. The reaction product of the hydrolyzed silane may be linear, partially crosslinked, a dimer, a trimer, and the like.

A suitable charge blocking layer may be fabricated from a solution of zirconium butoxide and gamma-amino propyl tri-methoxy silane in a suitable solvent such as anisisopropyl alcohol, butyl alcohol and water mixture. Generally, an exemplary solution comprises between about 70 and about 90 by weight of zirconium butoxide and between about 30 and about 10 by weight of gamma-amino propyl tri-methoxy silane, based on the total weight of solids in the solution.

The blocking layer should be continuous and have a thickness of less than about 0.5 micrometer because greater thicknesses may lead to undesirably high residual voltage. A blocking layer of between about 0.005 micrometer and about 0.3 micrometer (50 Angstroms-3000 Angstroms) is desirable because charge neutralization after the exposure step is facilitated and optimum electrical performance is achieved. A thickness of between about 0.03 micrometer and about 0.06 micrometer is desirable for metal oxide layers for optimum electrical characteristics.

An optional adhesive layer may be applied to the charge blocking layer. Adhesive layer materials are well known in the art. Typical adhesive layer materials include, for example, polyesters, MOR-ESTER 49,000 (available from Morton International Inc.), Vitel PE-100, Vitel PE-200, Vitel PE-200D, and Vitel PE-222 (all Vitels available from Goodyear Tire and Rubber Co.), polyarylates (Ardel, available from Toyota Hsutsu Inc.), polysulfone (available from AMOCO Production Products), polyurethanes, and the like. The MOR-ESTER 49,000 polyester resin is a linear saturated copolyester reaction product of ethylene glycol with terephthalic acid, isophthalic acid, adipic acid and azelaic acid. Other polyester resins which are chemically similar to the 49,000 polyester resin and which are also suitable for a photoreceptor undercoat layer coating include Vitel PE-100 and Vitel PE-200, both of which are available from Goodyear Tire & Rubber Co. Satisfactory results may be achieved with a dry undercoat layer thickness between about 0.05 micrometer and about 0.3 micrometer. Conventional techniques for applying an undercoat layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like. In some embodiments, the undercoat layer functions as a blocking layer and there is no need for a separate blocking layer beneath the undercoat layer.

The charge generating layer comprises a photoconductive particle and a polymer film forming binder. Photoconductive particles suitable for the charge generating layer include photoconductive particles such as vanadyl phthalocyanine, hydroxygallium phthalocyanine, chlorogallium phthalocyanine, metal free phthalocyanine, metal phthalocyanines, benzimidazole perylene, dibromoanthanthrone, and trigonal selenium, which are especially sensitive to white light.

Any suitable polymeric film forming binder material may be employed as the matrix in the charge generating (photogenerating) layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers. The preferred binders for pigment particles for adequate to good dispersion (of the pigment in the binder) are polyvinyl butyral (PVB) and poly(4,4'-diphenyl-1,1'-cyclohexane carbonate) (PCZ). However, although PVB is a good binder for applications employing drum substrates, PVB is not preferred for belt applications because it usually does not adhere as well to the other layers. PCZ is the preferred binder for belt applications. The choice of generator layer binder also determines the sensitivity and the shape of the Photo-induced Discharge Characteristics (PIDC). One factor in this may be due to the solubility considerations of the transport layer molecule in the generator layer binder. The transport layer molecules diffuse into the generator layer during the transport layer coating.

Any suitable organic solvent may be utilized to dissolve the film forming binder. Typical solvents include tetrahydrofuran, methylene chloride, n-butyl acetate, cyclohexanone, methyl ethyl ketone (MEK) and the like. Coating dispersions for charge generating layer may be formed by any suitable technique using, for example, attritors, ball mills, Dynomills, paint shakers, homogenizers, microfluidizers, and the like.

The charge generating layer containing photoconductive pigments and the resinous binder material generally has a thickness of between about 0.1 micrometer and about 5 micrometers. In embodiments, the charge generating layer has a thickness of between about 0.3 micrometer and about 3 micrometers. The charge generating layer thickness is related to binder content. Higher binder content compositions generally require thicker layers for photogeneration. Thicknesses outside these ranges can be selected providing the objectives of the present disclosure are achieved. Typical charge generating layer thicknesses have an optical density of between about 0.8 and about 2.5.

Any suitable and conventional technique may be utilized to mix and thereafter apply the charge generating layer coating mixture. Typical application techniques include slot coating, gravure coating, roll coating, spray coating, spring wound bar coating, dip coating, draw bar coating, reverse roll coating, and the like.

Any suitable drying technique may be utilized to solidify and dry the deposited coatings. Typical drying techniques include oven drying, forced air drying, infrared radiation drying, and the like.

The charge generating composition or pigment is present in the resinous binder composition in various amounts. Generally, however, from about 5 percent by volume to about 90 percent by volume of the charge generating pigment is dispersed in about 10 percent by volume to about 95 percent by volume of the resinous binder. In an exemplary embodiment, from about 30 percent by volume to about 60 percent by volume of the charge generating pigment is dispersed in about 40 percent by volume to about 70 percent by volume of the resinous binder composition.

The charge generating layer of a photoreceptor in accordance with the present disclosure comprises, in embodiments, a phthalocyanine pigment as a solution coated layer containing the pigment dispersed in a film forming resin binder. An exemplary phthalocyanine pigment is hydroxygallium phthalocyanine. Hydroxygallium phthalocyanine may be ground into fine particles having an average particle size of less than about 1 micrometer. Optimum results are achieved with a pigment particle size between about 0.2 micrometer and about 0.3 micrometer. Other suitable charge generation materials known in the art may also be utilized, if desired.

A charge transport layer in accordance with the present disclosure comprises a charge transport material, a film forming resin binder, and a doping agent. In particular, the charge transport layer includes, as a doping agent, a polyarylate polymer.

Any suitable charge transport layer containing the charge transport layer composition in accordance with the present disclosure may be utilized adjacent the charge generator layer. The active charge transport layer may comprise any suitable transparent organic polymer or non-polymeric material capable of supporting the injection of photo-generated holes and electrons from the charge generating layer and allowing the transport of these holes or electrons through the organic layer to selectively discharge the surface charge. The charge transport layer is generally a material which is an insulator to the extent that an electrostatic charge placed on the transport layer is not conducted in the absence of activating illumination. Thus, the active charge transport layer is a substantially non-photoconductive material which supports the injection of photogenerated holes from the generation layer.

The charge transport materials may comprise an alkyl derivative of an aryl amine compound and an alkoxy derivative of an arylamine compound. Typical arylamine compounds include triphenyl amines, bis and poly triarylamines, bis arylamine ethers, bis alkyl-arylamines and the like.

The charge transport layer forming mixture may comprise an aromatic amine compound of one or more compounds having the general formula:

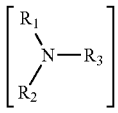

wherein $R_1$ and $R_2$ are an aromatic group selected from the group consisting of a substituted or unsubstituted phenyl group, naphthyl group, and polyphenyl group, and $R_3$ is selected from the group consisting of a substituted or unsubstituted aryl group, alkyl group having from 1 to about 18 carbon atoms and cycloaliphatic compounds having from about 3 to about 18 carbon atoms. The substituents should preferably be free from electron withdrawing groups such as $NO_2$ groups, CN groups, and the like.

Examples of charge transporting aromatic amines represented by the structural formula above for charge transport layers capable of supporting the injection of photogenerated holes of a charge generating layer and transporting the holes through the charge transport layer include bis(4-diethylamino-2-methyl-phenyl)phenyl-methane; 4'-4-bis(diethylamino)-2',2-dimethytriphenylmethane; N,N,'-bis(alkylphenyl)-[1,1'-biphenyl]-4,4'-diamine wherein the alkyl is, for example, methyl, ethyl, propyl, n-butyl, etc.; N,N'-diphenyl-N,N'-bis(chlorophenyl)-[1,1'-biphenyl]-4,4'-diamine; N,N'-diphenyl-N,N'-bis(3-methylphenyl)-(1,1'-biphenyl)-4,4'-diamine; N,N'-diphenyl-N,N'-bis(3-hydroxphenyl)-(1,1'-biphenyl)-4,4'-diamine, tritolyl amine; N,N-bis(3,4-dimethylphenyl)-1-aminobiphenyl, and the like dispersed in an inactive resin binder.

The charge transport material, in embodiments, comprises an arylamine compound. Arylamine charge transport materials can be subdivided into monoamines, diamines, triamines, etc.

Examples of aryl monoamines include, but are not limited to, bis-(4-methylphenyl)-4-biphenylylamine; bis(4-methoxyphenyl)-4-biphenylylamine; bis-(3-methylphenyl)-4-biphenylylamine; bis(3-methoxyphenyl)-4-biphenylylamine-N-phenyl-N-(4-biphenylyl)-p-toluidine; N-phenyl-N-(4-biphenylyl)-p-toluidine; N-phenyl-N-(4-biphenylyl)-m-anisidine; bis(3-phenyl)-4-biphenylylamine; N,N,N-tri[3-methylphenyl]amine; N,N,N-tri[4-methylphenyl]amine; N,N-di(3-methylphenyl)-p-toluidine; N,N-di(4-methylphenyl)-m-toluidine; bis-N,N-[(4'-methyl-4-(1,1'-biphenyl)]-aniline; bis-N,N-[(2'-methyl-4(1,1'-biphenyl)]-aniline; bis-N,N-[(2'-methyl-4(1,1'-biphenyl)]-p-toluidine; bis-N,N-[(2'-methyl-4(1,1'-biphenyl)]-m-toluidine; and N,N-di-(3,4-dimethylphenyl)-4-biphenylamine (DBA), and mixtures thereof.

The charge transport compounds may also include aryl diamines as described in U.S. Pat. Nos. 4,306,008, 4,304,829, 4,233,384, 4,115,116, 4,299,897, 4,265,990, 4,081,274 and 6,214,514, each incorporated herein by reference. Typical aryl diamine transport compounds include, but are not limited to, N,N'-diphenyl-N,N'-bis(alkylphenyl)-[1,1'-biphenyl]-4,4'-diamine wherein the alkyl is linear such as for example, methyl, ethyl, propyl, n-butyl and the like; N,N'-diphenyl-N,N'-bis(3-methylphenyl)-[1,1'-biphenyl]-4,4'-diamine (TPD); N,N'-diphenyl-N,N'-bis(3-hydroxyphenyl)-(1,1'-biphenyl)-4,4'-diamine (DHTPD); N,N'-diphenyl-N,N'-bis(4-methylphenyl)-[1,1'-biphenyl]-4,4'-diamine; N,N'-diphenyl-N,N'-bis(2-methylphenyl)-[1,1'-biphenyl]-4,4'-diamine; N,N'-diphenyl-N,N'-bis(3-ethylphenyl)-[1,1'-biphenyl]-4,4'-diamine; N,N'-diphenyl-N,N'l-bis(4-ethylphenyl)-[1,1'-biphenyl]-4,4'-diamine; N,N'-diphenyl-N,N'-bis(4-n-butylphenyl)-[1,1'-biphenyl]-4,4'-diamine; N,N'-diphenyl-N,N'-bis(3-chlorophenyl)-[1,1'-biphenyl]-4,4'-diamine; N,N'-diphenyl-N,N'-bis(4-chlorophenyl)-[1,1'-biphenyl]-4,4'-diamine; N,N'-diphenyl-N,N'-bis(phenylmethyl)-[1,1'-biphenyl]-4,4'-diamine; N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, mixtures thereof and the like.

Any suitable inactive film forming resin binder soluble in methylene chloride or other suitable solvent may be employed in the process of forming a charge transport layer in accordance with the present disclosure. Typical inactive solvent soluble resin binders include, for example, polycarbonate resin, polyester, polyarylate, polyacrylate, polyether, polysulfone, and the like. Weight average molecular weights can vary, for example, from about 20,000 to about 1,500,000.

Examples of suitable electrically inactive resin materials include, but are not limited to, polycarbonate resins having a weight average molecular weight from about 20,000 to about 120,000, and in some embodiments from about 50,000 to about 100,000. Specific examples of materials suitable as the electrically inactive film forming resin material include, but are not limited to, poly(4,4'-dipropylidene-diphenylene carbonate) with a weight average molecular weight of from about 35,000 to about 40,000, available as Lexan 145 from General Electric Company; poly(4,4'-isopropylidene-diphenylene carbonate) with a weight average molecular weight of from about 40,000 to about 45,000, available as Lexan 141 from the General Electric Company; a polycarbonate resin having a weight average molecular weight of from about 50,000 to about 100,000, available as Makrolon from Farbenfabricken Bayer A.G., a polycarbonate resin having a weight average molecular weight of from about 20,000 to about 50,000 available as Merlon from Mobay Chemical Company and poly(4,4'-diphenyl-1,1'-cyclohexane carbonate) with a molecular weight of from about 35,000 to about 40,000, available as PCZ 400 available from Mitsubishi Chemical Co. Excellent results are achieved when the charge transport layer comprises N,N'-diphenyl-N,N'-bis(3-methylphenyl)-[1,1'-biphenyl]-4,4'-diamine and one or more of N,N'-diphenyl-N,N'bis[3-methoxyphenyl]-1,1'-biphenyl]-4,4'diamine, N,N'-diphenyl-N,N'bis[4-methoxyphenyl]-1,1'-biphenyl]-4,4'diamine, 4-methoxyphenyldiphenylamine, bis[4-methoxyphenyl]phenylamine, tris[4-methoxyphenyl]amine, in poly(4,4'-dipropylidene-diphenylene carbonate) binder.

Examples of photosensitive members having at least two electrically operative layers include the charge generator layer and diamine containing transport layer members disclosed in U.S. Pat. Nos. 4,265,990, 4,233,384, 4,306,008, 4,439,507. The disclosures of these patents are incorporated by reference herein in their entirety.

Additionally, a charge transport layer in accordance with the present disclosure includes an acid doping agent comprising an arylate polymer composition to stabilize the transport properties of the charge transport materials. In this regard, any suitable polyarylate film forming thermoplastic ring compound may be utilized in the charge transport layer composition. Polyarylates are derived from aromatic dicarboxylic acids and diphenols and their preparation is well known. In one embodiment, the polyarylates used as a doping agent in a CTL in accordance with the present disclosure are prepared from isophthalic or terephthalic acids and bisphenol A. In general, there are two processes that are widely used to prepare polyarylates. The first process involves reacting acid chlorides, such as isophthaloyl and terephthaloyl chlorides, with diphenols, such as bisphenol A, to yield polyarylates. The acid chlorides and diphenols can be treated with a stoichiometric amount of an acid acceptor, such as triethylamine or pyridine. Alternatively, an aqueous solution of the dialkali metal salt of the diphenols can be reacted with a solution of the acid chlorides in a water-insoluble solvent such as methylene chloride, or a solution of the diphenol and the acid chlorides can be contacted with solid calcium hydroxide with triethylamine serving as a phase transfer catalyst. The second process involves polymerization by a high-temperature melt or slurry process. For example, diphenyl isophthalate or terephthalate is reacted with bisphenol A in the presence of a transition metal catalyst at temperatures greater than 230° C. Since transesterification is a reversible process, phenol, which is a by-product, must be continually removed from the reaction vessel in order to continue polymerization and to produce high molecular weight polymers. Various processes for preparing polyarylates are disclosed in "Polyarylates," by Maresca and Robeson in Engineering Thermoplastics, James Margolis, ed., New York: Marcel Dekker, Inc. (1985), pages 255-259, which is incorporated herein by reference as well as the articles and patents disclosed therein which describe the various processes in greater detail.

A typical polyarylate has repeating units represented in the following formula:

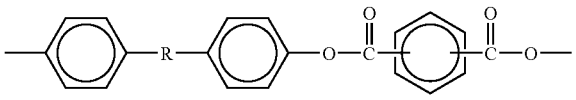

wherein R is $C_1$-$C_6$ alkylene. In one particular embodiment R is a $C_3$ alkylene. Polyarylates of the above formula typically have a weight average molecular weight greater than about 5,000 and, in embodiments, greater than about 30,000. In one embodiment, the polyarylate polymers have recurring units of the formula:

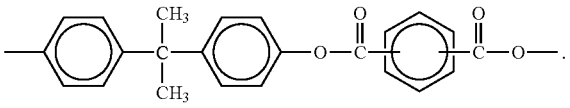

The phthalate moiety may be from isophthalic acid, terephthalic acid or a mixture of the two. In one embodiment, the phthalate moiety solely comprises one of isophthalic acid or terephthalic acid. In another embodiment, the phthalate moiety comprises a mixture of isophthalic acid and terephthalic acid at any suitable ratio ranging from about 99 mol percent isophthalic acid and about 1 mol percent terephthalic acid to about 1 mol percent isophthalic acid and about 99 mol percent terephthalic acid. In another embodiment, the phthalate moiety may comprise from about 25 to 75 percent isophthalic acid and from about 25 to about 75 mol percent terephthalic acid. In still another embodiment, the phthalate moiety comprises a mixture of about 75 percent isophthalic acid and about 25 percent terephthalic acid. In a further embodiment, the phthalate moiety comprises a mixture of about 50 percent isophthalic acid and about 50 percent terephthalic acid. Examples of suitable polyarylates include Ardel from Amoco and Durel from Celanese Chemical Company. A particularly suitable polyarylate polymer is available from the Toyota Hsutsu Corp. under the tradename Ardel D-100. Ardel is prepared from bisphenol-A and a mixture of 50 mol percent each of terephthalic and isophthalic acid chlorides by conventional methods. Ardel D-100 has a melt flow at 375° C. of 4.5 g/10 minutes, a density of 1.21 Mg/m3, a refractive index of 1.61, a tensile strength at yield of 69 MPa, a thermal conductivity (k) of 0.18 W/m°K and a volume resistivity of 3×1016 ohm-cm. Durel is an amorphous homopolymer with a weight average molecular weight of about 20,000 to 200,000. Different polyarylates may be blended in the compositions of the development. Suitable polyarylates also include those disclosed in U.S. Pat. Nos. 6,699,850 and 5,492,785, the entire disclosures of which are incorporated herein by reference.

A charge transport layer in accordance with the present disclosure comprises a charge transport material in an amount of from about 25 to about 75 percent by weight, a polymeric binder in an amount of from about 25 to about 75 percent by weight, and an effective amount of an arylate polymer to increase the photosensitivity of the photoreceptor and decrease at least one of the $V_r$ and $V_{BG}$. In embodiments, a charge transport layer comprises an arylate polymer in an amount of at least about 0.1% by weight, solids basis. In another embodiment, the charge transport layer comprises an arylate polymer in an amount of at least about 1.0% by weight, solids basis. In still another embodiment, a charge transport layer comprises an arylate polymer in an amount of from about 0.1 to about 10.0% by weight, solids basis.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used. In embodiments, the transport layer has a dried thickness of between about 18 micrometers and about 35 micrometers, with optimum results being achieved with a thickness between about 20 micrometers and about 29 micrometers.

Other layers such as conventional ground strips comprising, for example, conductive particles disposed in a film forming binder may be applied to one edge of the photoreceptor in contact with the conductive surface or layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

Processes of imaging, especially xerographic imaging and printing, including digital, are also encompassed by the present disclosure. More specifically, the layered photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

The following examples describe exemplary embodiments of the present development. These examples are merely illustrative, and in no way limit the present disclosure to the specific materials, conditions or process parameters set forth therein. All parts and percentages are by weight unless otherwise indicated.

EXAMPLE 1

Preparation of Photogenerating Layer of Imaging Member

An imaging member was prepared by providing a 0.02 micrometer thick titanium layer coated on a biaxially oriented polyethylene naphthalate substrate (KALEDEX™ 2000) having a thickness of 3.5 mils. Applied thereon with a gravure applicator, was a solution containing 50 grams 3-amino-propyltriethoxysilane, 41.2 grams water, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 500 Angstroms.

An adhesive layer was then prepared by applying a wet coating over the blocking layer, using a gravure applicator, containing 0.2 percent by weight based on the total weight of the solution of polyarylate adhesive (Ardel D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 angstroms.

A photogenerating layer dispersion was prepared by introducing 0.45 grams of lupilon200® (PC-Z 200) available from Mitsubishi Gas Chemical Corp and 50 ml of tetrahydrofuran into a 4 oz. glass bottle. To this solution were added 2.4 grams of hydroxygallium phthalocyanine and 300 grams of ⅛ inch (3.2 millimeter) diameter stainless steel shot. This mixture was then placed on a ball mill for 8 hours. Subsequently, 2.25 grams of PC-Z 200 was dissolved in 46.1 gm of tetrahydrofuran, and added to this OHGaPc slurry. This slurry was then placed on a shaker for 10 minutes. The resulting slurry was, thereafter, applied to the adhesive interface with a Bird applicator to form a charge generation layer having a wet thickness of 0.25 mil. However, a strip about 10 mm wide along one edge of the substrate web bearing the blocking layer and the adhesive layer, was deliberately left uncoated without any photogenerating layer material, to facilitate adequate electrical contact by the ground strip layer that was to be applied later. The charge generation layer was dried at 120° C. for 1 minute in a forced air oven to form a dry charge generation layer having a thickness of 0.4 micrometer.

EXAMPLE 2

Coating with Transport Layer

A coating sample of Example I was coated with a transport layer containing 50 weight percent (based on the total solids) of hole transport compound, N,N'-diphenyl-N,N'-bis(3-methyl-phenyl)-(1,1'-biphenyl)-4,4'-diamine.

In a four ounce brown bottle, 10 grams of MAKROLON® 5705 (available from Bayer Chemicals) was dissolved in 113 grams of methylene chloride. After the polymer was completely dissolved, 10 grams of N,N'-diphenyl-N,N'-bis(3-methylphenyl)-1,1'-biphenyl-4~4'-diamine was added to the solution. The mixture was shaken overnight to assure a complete solution. The solution was applied onto the photogenerating layer made in Example 1 using a 4.5 mil Bird bar to form a coating. The coated device was then heated in a forced air oven at 120° C. for 1 minute to form a charge transport layer having a dry thickness of 29 micrometers.

EXAMPLE 3

A photoreceptor was prepared as in example 2 except for the following. The transport layer solution was prepared by using an amount of 9.9 gm MAKROLON® 5705, and 0.1 gm of Ardel D-100 polyarylate. The mixture has 0.5% polyarylate based on overall solids.

EXAMPLE 4

A photoreceptor was prepared as in example 2 except for the following. The transport layer solution was prepared by using an amount of 9.8 gm MAKROLON® 5705, and 0.2 gm of Ardel D-100 polyarylate. The mixture has 1.0% polyarylate based on overall solids.

EXAMPLE 5

A photoreceptor was prepared as in example 2 except for the following. The transport layer solution was prepared by using an amount of 9.6 gm MAKROLON® 5705, and 0.4 gm of Ardel D-100 polyarylate. The mixture has 2.0% polyarylate based on overall solids.

EXAMPLE 6

A photoreceptor was prepared as in example 2 except for the following. The transport layer solution was prepared by using an amount of 9.0 gm MAKROLON® 5705, and 1.0 gm of Ardel D-100 polyarylate. The mixture has 5.0% polyarylate based on overall solids.

EXAMPLE 7

Testing of Photoreceptor Sheets for Surface Potential after Exposure

The flexible photoreceptor sheets prepared as described in Examples 2 through 6 were tested for their xerographic sensitivity and cyclic stability in a scanner. In the scanner, each photoreceptor sheet to be evaluated was mounted on a cylindrical aluminum drum substrate, which was rotated on a shaft. The devices were charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed to a light source located at a position near the drum downstream from the corotron. As the drum was rotated, the initial (pre-exposure) charging potential was measured by voltage probe 1. Further rotation lead to an exposure station, where the photoreceptor device was exposed to monochromatic radiation of a known intensity. The devices were erased by a light source located at a position upstream of charging. The measurements illustrated in Table 1 below include the charging of each photoconductor device in a constant current or voltage mode. The devices were charged to a negative polarity corona. The surface potential after exposure was measured by a second voltage probe. The devices were finally exposed to an erase lamp of appropriate intensity and any residual potential was measured by a third voltage probe. The process was repeated with the magnitude of the exposure automatically changed during the next cycle. The photodischarge characteristics were obtained by plotting the potentials at voltage probe 2 as a function of light exposure. Dark decay is determined as the difference between the initial charging potential and the charge potential after 0.66 seconds without exposure to monochromatic radiation.

TABLE 1

| EXAMPLE | Vbg at 0 cycles Volts | Vbg at 10k cycles Volts | Stability of Vbg | Vr at 0 cycles Volts | Vbg at 10K cycles Volts | Stability of Vr | Dark decay Volts |
|---|---|---|---|---|---|---|---|
| 2 | 129 | 191 | 62 | 93 | 136 | 43 | 155 |
| 3 | 82 | 121 | 41 | 42 | 62 | 20 | 153 |
| 4 | 57 | 74 | 17 | 19 | 20 | 1 | 103 |
| 5 | 51 | 64 | 13 | 15 | 14 | 1 | 101 |
| 6 | 41 | 48 | 7 | 9 | 5 | 4 | 108 |

As displayed in Table 1, photoreceptor sensitivity is increased in a device comprising a CTL doped with a polyarylate polymer, such as Ardel, as compared to a device without any doping agent in the CTL. In the coatings comprising the doped CTL, $V_r$ decreased by 54 to 90% and $V_{BG}$ decreased by 36 to 68% as compared to the non-doped CTL coatings. Further, the extent of the $V_r$ decrease is generally proportional to the polyarylate doping. The results in Tables 1 and 2 also show that doping the CTL with a polyarylate results in a decrease in the dark decay.

The effect of doping a CTL with a polyarylate on cyclic stability of Vbg and Vr is also shown in Table 1. Table 1 shows the difference of $V_r$ and Vbg performance at zero and 10,000 cycles As shown in Table 1, the photoreceptor is cycle stable at 10,000 cycles with at least about 1.0% doping of the CTL. Without doping, the $V_r$ cycles up by about 43 volts. Table 1 also shows, that doping the CTL with as little as about 0.5% of a polyarylate significantly lowers the $V_r$ at both zero cycles and at 10,000 cycles.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A photoconductive imaging member comprising:

a substrate;

an optional hole blocking layer;

an optional adhesive layer, a charge generating layer; and a charge transport layer comprising a binder, a charge transport material, and a polyarylate doping agent in an amount of from about 0.1 to about 1 percent by weight, solids basis, of the charge transport layer, said doping agent consisting of a phthalate moiety and a diphenol moiety and having the formula

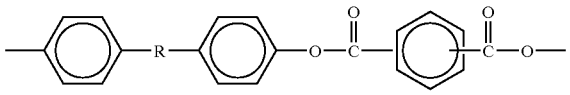

wherein R is selected from the group consisting of $C_1$-$C_6$ alkylene and wherein said phthalate moiety is selected from the group consisting of isophthalic acid, terephthalic acid, and combinations thereof.

2. The photoconductive imaging member of claim 1, wherein the polyarylate doping agent is present in an amount of from 0.1 to 1.0 percent, solids basis, of the charge transport layer.

3. The photoconductive imaging member of claim 1, wherein said polyarylate doping agent has a weight average molecular weight of from about 5,000 to about 30,000.

4. A photoconductive imaging member comprising:

a substrate;

an optional hole blocking layer;

an optional adhesive layer, a charge generating layer; and a charge transport layer comprising a binder, a charge transport material, and a polyarylate doping agent in an amount of from about 0.1 to about 1 percent by weight, solids basis, of the charge transport layer, said doping agent consisting of a phthalate moiety and a diphenol moiety and having the formula

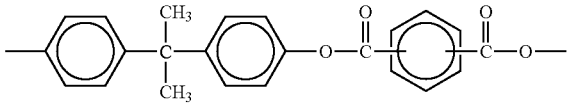

wherein said phthalate moiety is selected from the group consisting of isophthalic acid, terephthalic acid, and combinations thereof.

5. The photoconductive imaging member of claim 4, wherein said phthalate moiety comprises from about 1 to about 99 mol percent isophthalic acid and from about 1 to about 99 mol percent terephthalic acid.

6. The photoconductive imaging member of claim 4, wherein said phthalate moiety comprises about 75 percent isophthalic acid and about 25 percent terephthalic acid.

7. The photoconductive imaging member of claim 4, wherein said phthalate moiety comprises about 50 percent isophthalic acid and about 50 percent terephthalic acid.

8. The photoconductive imaging member of claim 4, wherein said polyarylate doping agent has a weight average molecular weight of from about 5,000 to about 200,000.

9. The photoconductive imaging member of claim 4, wherein said polyarylate doping agent has a weight average molecular weight of from about 5,000 to about 30,000.

10. The photoconductive imaging member of claim 4, wherein the polyarylate doping agent is present in an amount of from 0.1 to 1.0 percent, solids basis, of the charge transport layer.

11. A photoconductive imaging member comprising:

a substrate;

an optional hole blocking layer;

an optional adhesive layer, a charge generating layer; and a charge transport layer comprising a charge transport material, a binder, and a doping agent in an amount of from about 0.1 to about 1.0 percent, solids basis, of the charge transport layer, wherein said doping agent is a polyarylate polymer selected from the group consisting of a polyarylate having the following formula

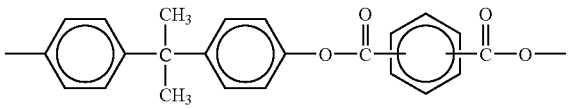

wherein the phthalate moiety comprises about 50 percent isophthalic acid and 50% terephthalic acid.

12. The photoconductive imaging member of claim 11, wherein said polyarylate has a weight average molecular weight of from about 5,000 to about 200,000.

13. The photoconductive imaging member of claim 11, wherein the polyarylate doping agent is present in an amount of from 0.1 to 1.0 percent, solids basis, of the charge transport layer.

* * * * *